US006360507B1

(12) United States Patent
Nevers et al.

(10) Patent No.: US 6,360,507 B1
(45) Date of Patent: Mar. 26, 2002

(54) UNIVERSAL SUPPORT CLIP FOR SUSPENDED CEILINGS

(75) Inventors: Craig S. Nevers; Steven M. Seligman, both of Warwick, RI (US)

(73) Assignee: Icon International, Inc., North Kingstown, RI (US)

( * ) Notice: Subject to any disclaimer, the term of this patent is extended or adjusted under 35 U.S.C. 154(b) by 0 days.

(21) Appl. No.: 09/645,853

(22) Filed: Aug. 24, 2000

(51) Int. Cl.[7] ..... E04B 2/00; E04B 5/00; E04B 9/00

(52) U.S. Cl. ..... 52/506.07; 52/714; 248/300; 248/317; 248/305; 248/306; 248/340

(58) Field of Search ..... 52/506.07, 712, 52/714, 715, 484; 248/300, 317, 305, 306, 340

(56) References Cited

U.S. PATENT DOCUMENTS 3,599,921 A * 8/1971 Cumber ..... 52/484
4,088,293 A 5/1978 Delmore
4,715,161 A 12/1987 Carraro et al.
5,533,696 A 7/1996 Laughlin et al.
5,667,181 A 9/1997 van Leeuwen et al.
5,687,525 A * 11/1997 Koski et al. ..... 52/506.07
5,713,157 A 2/1998 van Leeuwen et al.
5,740,994 A 4/1998 Laughlin
6,040,525 A 3/2000 Chauquet et al.

* cited by examiner

*Primary Examiner*—Carl D. Friedman
*Assistant Examiner*—Chi Nguyen
(74) *Attorney, Agent, or Firm*—Cook, Alex, McFarron, Manzo, Cummings & Mehler, Ltd.

(57) ABSTRACT

A system for supporting a suspended ceiling and for supporting fixtures below the suspended ceiling. The suspended ceiling includes an inverted, T-shaped grid of structural members. A mounting clip is provided that comprises two parts. A first, fixed part includes a first, horizontal leg, a second leg that depends from the first leg, and a third leg depending from the second leg. A second, reversible part comprises a central body with first and second ends. The central body includes either a locating hook or an aperture at each of the first and second ends that mates with a corresponding complementarily-shaped locating hook or aperture on the first and third legs of the first part of the clip. The second part of the mounting clip is also relieved adjacent each end. The relieved portions are of different shapes from each other so that the mounting clip can accommodate differently-shaped structural members.

19 Claims, 3 Drawing Sheets

UNIVERSAL SUPPORT CLIP FOR SUSPENDED CEILINGS

BACKGROUND OF THE INVENTION

This invention relates to a support clip or ceiling hanger for use with a suspended ceiling, and more particularly to a multi-part universal support clip adapted for use with a variety of support beam configurations for supporting independently therefrom lighting fixtures and similar devices.

Suspended ceilings are commonly used in commercial buildings because of their ease of installation and repair, the ready accessibility they provide to mechanical systems such as electrical, HVAC and communication, the adaptability of the ceiling to changing floor plans, and their relatively light weight.

A suspended ceiling is supported on its own grid system below a structural ceiling. The grid typically comprises a plurality of beams which may take various shapes. However, the beams are generally of an inverted T-shape and include a cross flange, a head, and a central web connecting the head to the cross flange. Ceiling panels are supported by the grid system, with the edges of the panels resting on the cross flanges of the T-shaped beams.

Building codes typically require that lighting fixtures and the like not be supported by the grids that support the ceiling panel members. Thus, independent support clips that are connected directly to the structural ceiling have been employed to support the lighting fixtures and other devices. While the support clips also support the grid system, however none of the weight of the fixtures supported by the clips is borne by the grid system. The clip is attached directly to the building ceiling structure by a drop-wire, thus transmitting the weight of the suspended fixture directly to the building and relieving the grid from undue load stress. See, e.g., U.S. Pat. No. 3,599,921.

The T-bars or support beams that comprise the grid are typically one of three different standard sizes and configurations: a flat cross flange measuring 15/16" in width (FIG. 3); a flat cross flange measuring approximately 9/16" in width (FIG. 4); and the cross flange comprising a bolt slot and measuring approximately 9/16" in width (FIG. 5). As a consequence, a unique drop-wire clip has heretofore been required for each different type of T-bar used for a suspended ceiling. This means that distributors and installers of clips are required to keep larger inventories in order to be sure to have available a sufficient number of clips suitable for use with each particular type of grid system.

Accordingly, it is the principal object of the present invention to provide an independent support or mounting clip for use with a suspended ceiling grid system that is adapted for use with any of the three principle T-bar configurations used for the ceiling grid.

It is a further object to provide such a mounting clip that is adapted to receive a bolt or the like for supporting a lighting fixture or other fixture.

SUMMARY OF THE INVENTION

These objects, as well as others which will become apparent upon reference to the following detailed description and accompanying drawings, are provided by a system for supporting a suspended ceiling and for supporting fixtures below the suspended ceiling in which the suspended ceiling includes an inverted, T-shaped grid of structural members, each structural member having a head portion, a cross flange for supporting the lateral edges of the panels comprising the suspended ceiling, and a central web that connects the cross flange to the head portion. The cross flange may have varying horizontal and vertical dimensions, depending upon which type of structural member is used.

A mounting clip is provided that comprises two parts. A first, fixed part includes a first, horizontal leg that is sized so that it underlies the horizontal portion of the cross flange of the structural member, a second leg that depends from the first leg that is sized and shaped to accommodate the vertical portion of the cross flange and the central web, and a third leg depending from the second leg that is sized to receive the head portion of the structural member.

A second, reversible part comprises a central body with first and second ends. The central body includes either a locating hook or an aperture at each of the first and second ends that mates with a corresponding complementarily shaped locating hook or aperture on the first and third legs of the first part of the clip. The second part of the mounting clip is also relieved adjacent each end in a first area corresponding to the horizontal and vertical dimensions of the cross flange of the structural member and in a second area corresponding to the head portion of the structural member. The relieved portions are of different shapes from each other so that, depending upon the orientation of the second part of the clip with respect to the first part, the mounting clip can accommodate the different structural members.

DETAILED DESCRIPTION OF THE PREFERRED EMBODIMENTS

Figure 1:
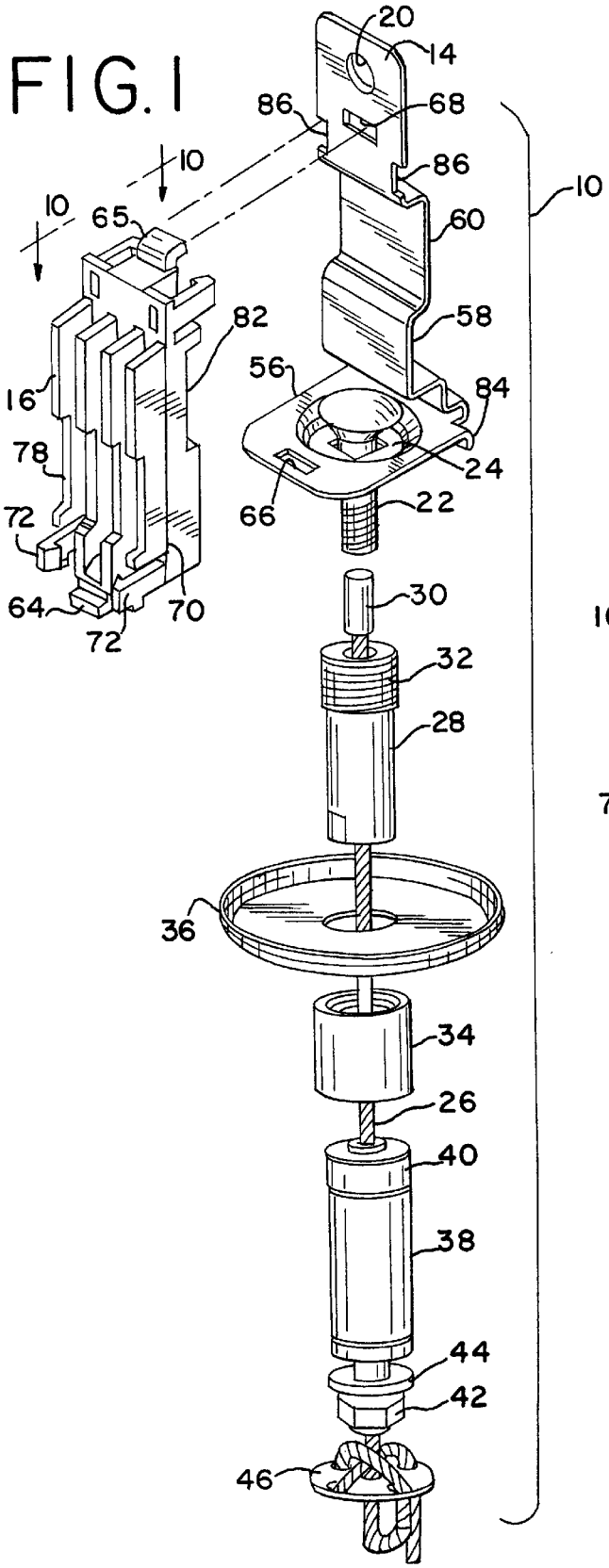
FIG. 1 is an exploded perspective view of a mounting clip and fixture support system in accordance with the present invention.
Figure 2:
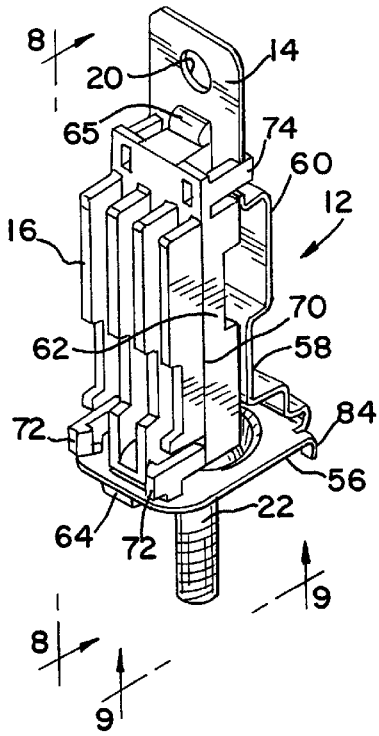
FIG. 2 is a perspective view of the mounting clip of FIG. 1.

Turning to FIG. 1, there is seen a universal mounting clip and fixture support assembly 10 for use with a suspended ceiling in accordance with the present invention.

Figure 3:
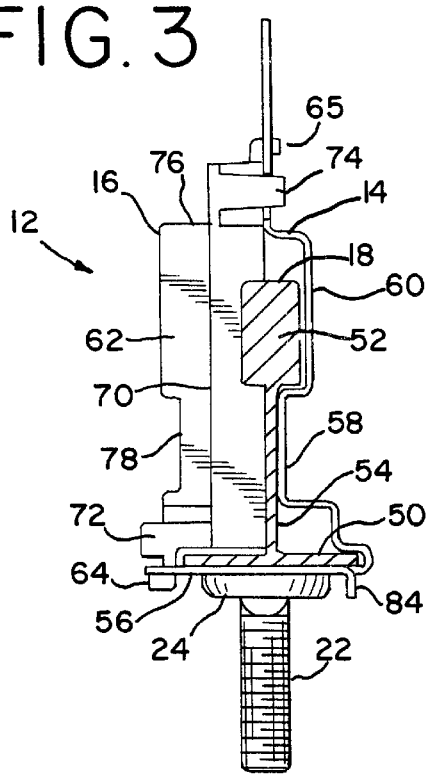
FIG. 3 is a plan view showing a mounting clip in accordance with the present invention in combination with a first type of T-beam structural member, shown in cross section.
Figure 4:
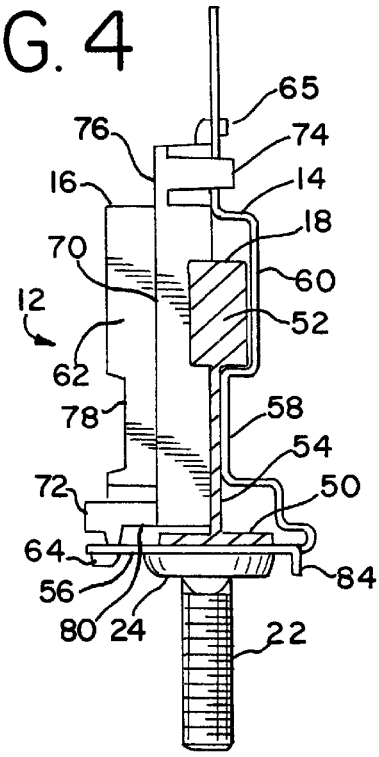
FIG. 4 is a plan view showing a mounting clip in accordance with the present invention in combination with a second type of T-beam structural member, shown in cross section.
Figure 5:
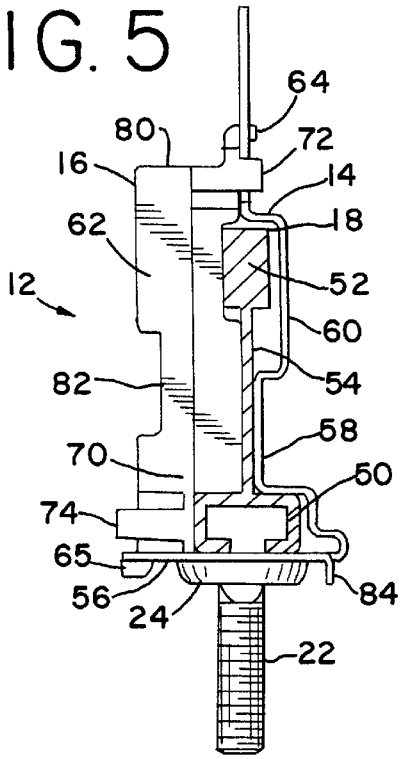
FIG. 5 is a plan view of a mounting clip according to the present invention in combination with a third type of T-beam structural member, shown in cross section, that accommodates a bolt.
Figure 6:
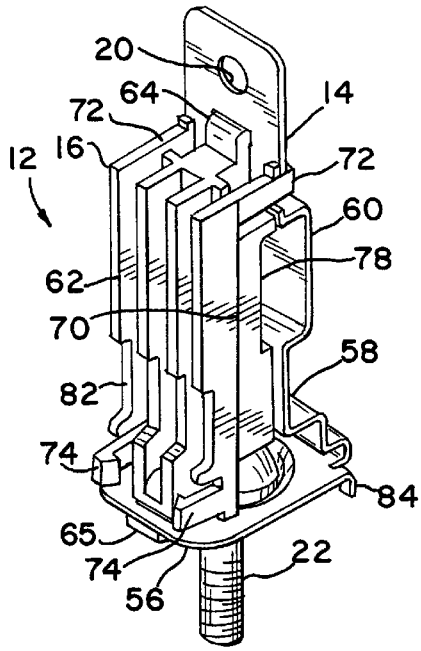
FIG. 6 is a perspective view of a mounting clip according to the present invention in which the second part of the clip is shown in its alternate position to that of FIG. 2.
Figure 7:
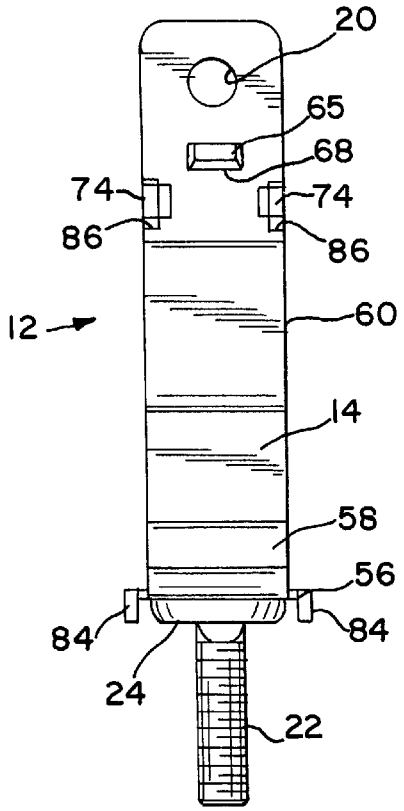
FIG. 7 is a side view of a mounting clip according to the present invention.
Figure 8:
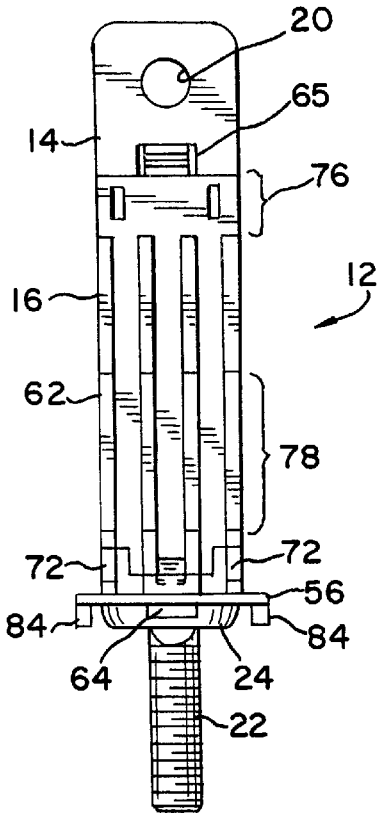
FIG. 8 is a side view from the opposite side of FIG. 7 of a mounting clip according to the present invention.
Figure 9:
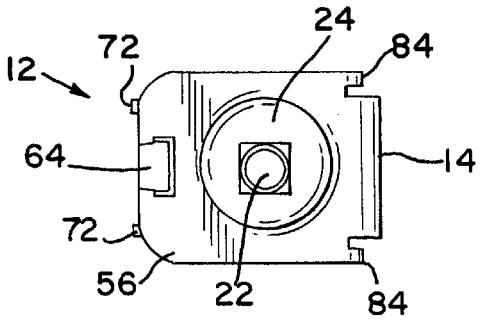
FIG. 9 is a bottom view of a mounting clip according to the present invention.
Figure 10:
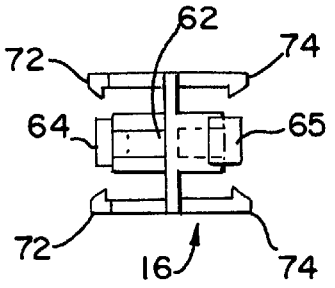
FIG. 10 is a top view of the second part of a mounting clip according to the present invention.

The assembly 10 includes a two-part mounting clip 12 that includes a first, fixed member 14 and a second, reversible member 16 that together cooperate to define an opening for the passage of a T-bar support beam 18, seen in cross section in FIGS. 3–5.

The first member 14 is typically made of a spring steel, preferably 20 Gauge galvanized steel, and includes an aperture 20 which receives a wire tie (not shown) that secures the clip 12 directly to a main structure that overlies the suspended ceiling. The second member 16 is preferably made of a durable plastic, such as glass-filled nylon.

The first member 14 also supports a carriage bolt 22 in a countersunk hole 24, the depth of the countersink being such that the head of the carriage bolt 22 sits flush with or below the cross flange of the T-bar 18 supported by the clip 12. A braided steel cable 26, commonly known as "aircraft cable," is provided for suspending light fixtures and the like from the clip 12. The cable 26 is secured to the carriage bolt 22 by means of an internally-threaded coupler 28 that mates with the external threads on the carriage bolt 22. A head 30 on the cable 26 engages an internal shoulder (not shown) on the coupler 28 to secure the cable to the coupler. The coupler 28 also includes an externally-threaded portion 32 at its upper end that mates with the internal threads of a second coupler 34 used to secure a canopy 36 securely and squarely to the bottom of the clip 12.

The cable 26 also supports a moveable assembly 38, commonly known as a "griplock assembly" for securing a lighting fixture or other device to the cable 26. The griplock assembly 38 includes a grip nut 40 that, when loosened, permits the griplock assembly 38 to slide along the cable 26. Once the griplock assembly 38 is properly located on the cable 26, the grip nut 40 is tightened. The lighting fixture is secured to the bottom of the griplock assembly 38 by means of a retention nut 42 and washer 44. A safety washer 46 is positioned on the cable 26 below the griplock assembly 38, and the cable 26 is woven through the holes in the washer 46 to secure the washer to the cable.

In keeping with the invention, the mounting clip 12 is configured so that it may be used with any one of the three most-commonly available T-bars 18. These T-bars 18 are shown in combination with the clip 12 of the present invention in FIGS. 3–5. In each of FIGS. 3–5, the T-bar 18 includes a cross flange 50 for supporting the lateral edges of the ceiling panels, a head 52 typically including apertures for receiving wire ties so that the T-bar could be directly attached to the structural ceiling, and a central web 54 connecting the cross flange 50 to the head 52. The cross flange 50 in each of the T-bars 18 of FIGS. 3–5 differs. FIG. 3 illustrates a T-bar 18 with a flat cross flange 50 that nominally measures 15/16" in width. FIG. 4 illustrates a T-bar 18 with a flat cross flange 50 that nominally measures 9/16" in width. FIG. 5 illustrates a T-bar 18 with a cross flange 50 in the form of a slot that accommodates the head of a bolt. The cross flange of the T-bar 18 of FIG. 5 also nominally measures 9/16" in width. In contrast to the flat cross flange 50 of the T-bars 18 of FIGS. 3 and 4, the cross flange of T-bar of FIG. 5 has a vertical dimension that corresponds to the height of the head of the bolt that may be received in the slot.

Thus, the first, fixed part 14 and second, reversible part 16 of the clip 12 are configured so that the clip 12 can accommodate each of the three different T-bar configurations 18 by simply reversing the second part 16 with respect to the first part 14. To this end, the first part 14 of the clip 12 has a horizontal leg 56 sized in length so as to underlie the widest of the cross flanges 50 of the various T-bars 18. A second leg 58 depends from the first horizontal leg 56 that is sized and shaped to accommodate the cross flange of the T-bar with the largest vertical dimension, i.e., the bolt slot T-bar of FIG. 5, and at least a portion of the vertical extent of the central web 54 of the T-bar. A third leg 60 depends from the second leg and is configured to receive the head portion 52 of the T-bar.

The second part 16 of the clip 12 includes a central body 62 that includes locating hooks 64, 65 on the opposite faces of each end. The locating hooks 64, 65 mate with either of apertures 66 and 68 on the first and third legs 56, 60 of the first part 14 of the clip. Specifically, the locating hooks 64, 65 are spaced equidistant from a center line 70 of the body 62 so that the locating hooks will mate with the apertures 66, 68 both in the positions shown in FIG. 3 and FIG. 5.

The second part of the clip also includes a pair of resilient locking tabs 72, 74 adjacent each locating hook 64, 65, respectively. The locking tabs 72, 74 are positioned to engage the lateral edges of the third leg 60 of the first member 14 when its adjacent locating hook is received in the aperture 60. Of course, the first and second members 14, 16 of the clip could be configured so that the locking tabs are on the third leg 60 of the first member 14, and the locating hooks 64, 65 located on the first and third legs of the first member, with the second part 16 of the clip having apertures for receiving the locating hooks.

The central body 62 of the second part 16 of the clip 12 is also relieved in two areas adjacent each pair of locking tabs 72, 74. A first area 76 is relieved in a shape corresponding to the horizontal and vertical dimensions of the cross flange 50 that has the largest horizontal and vertical dimensions, i.e., that of FIG. 5. The central body is relieved at 78 so as to accommodate the head 52 of the T-bar of FIG. 5. On the opposite side of the center line 70, the central body is relieved at 80 so as to receive the cross flange of the T-bars of FIGS. 3 and 4, and relieved at 82 to receive the head of the T-bars of FIGS. 3 and 4.

Because the locating hooks 64, 65 protrude through the cross flange 50, the horizontal leg 56 also includes two short arms 84 that extend downwardly from the horizontal leg 56 to the same extent as the locating hooks 64, 65. This ensures that the canopy 36 has a flat surface to engage when tightened against the mounting clip 12 by the coupler 34.

In addition, the lateral edges of the third leg 60 of the first part 14 of the clip 12 may be relieved at 86 where it is engaged by the resilient tabs 72 or 74, depending upon the orientation of the reversible part 16 of the clip 12.

In use, the clip 12 is attached around a T-bar support beam 18 by first inserting the carriage bolt 22 into the countersunk hole 24 in the fixed part 14 of the clip. The fixed part 14 is then installed on the T-bar 18 so that the head of the bolt 22 is centered flush to the cross flange 50 of the T-bar 18. The reversible part 16 of the clip is then installed, selecting the appropriate side of the reversible part 16 based upon the T-bar configuration 18 in the ceiling grid. The appropriate locating hook 64 or 65 is inserted into the aperture 66 on the horizontal leg 56 of the fixed part of the clip 14, and then the reversible part of the clip 16 is pivoted towards the fixed part 14 of the clip until the other locating hook passes through the aperture 68 in the third leg 60 of the fixed part 14 of the clip. Simultaneously, the locking tabs 72 or 74 engage the lateral edges of the third leg 60 of the fixed part 14 of the clip. A wire tie (not shown) is then threaded through the aperture 20 in the fixed part 14 of the clip to secure the clip to the main structure.

Thus, it can be seen that a universal mounting clip for use with a suspended ceiling and a system for supporting fixtures in conjunction with a suspended ceiling has been provided. While the mounting clip and system have been described in terms of the preferred embodiment, there is no intent to limit the invention to the same. Instead, the invention is defined by the scope of the following claims.

What is claimed:

1. A mounting clip for attachment to a T-shaped structural member having a cross flange with a horizontal and vertical dimension, a head portion, and a central web connecting the cross flange to the head portion, the mounting clip comprising:

a first member having a first horizontal leg sized so as to underlie the horizontal portion of the cross flange of the structural member and having an aperture therein, a second leg depending from the first leg sized and shaped to accommodate the vertical portion of the cross flange and the central web, and a third leg depending from the second leg sized to receive the head portion of the structural member and having an aperture therein; and a second member having a central body with first and second ends with a locating hook at each end sized and shaped to mate with either of the apertures on the first and third legs of the first member, and a pair of resilient locking tabs adjacent each locating hook, the locking tabs positioned to engage the lateral edges of the third leg of the first member when the adjacent locating hook is received in the aperture in the third leg.

2. The mounting clip of claim 1 wherein the central body of the second member is relieved adjacent each pair of locking tabs in a first area corresponding to the horizontal and vertical dimensions of the cross flange of the structural member and in a second area corresponding to the head portion of the structural member.

3. The mounting clip of claim 2 wherein the first relieved areas are of different shape from each other and the second relieved areas are of different shape from each other so that the mounting clip can accommodate structural members of different sizes depending on the orientation of the second member of the mounting clip with respect to the first member.

4. The mounting clip of claim 1 wherein the clip is adapted to support a separate bolt having a head and shank, the first member further comprising a countersunk portion on the first leg, with a central aperture therein, the countersunk portion sized to receive the head of the bolt and the central aperture sized to receive the shank of the bolt.

5. The mounting clip of claim 4 wherein the first leg of the first member further includes a pair of arms extending therefrom to the same extent as the boss.

6. The mounting clip of claim 1 wherein the third leg has lateral edges which are relieved in the location where they are engaged by the tabs on the second member.

7. The mounting clip of claim 1 wherein the third leg of the first member includes a second aperture for receiving a tie wire.

8. A system for supporting a suspended ceiling and for supporting fixtures below the suspended ceiling comprising:

an inverted T-shaped structural member having a cross flange, a head portion, and a central web connecting the cross flange to the head portion, the cross flange having a horizontal dimension and a vertical dimension; and a mounting clip comprising a first member and a second member, the first member having a first horizontal leg sized so as to underlie the horizontal portion of the cross flange of the structural member and having an aperture therein, a second leg depending from the first leg sized and shaped to accommodate the vertical portion of the cross flange and the central web, and a third leg depending from the second leg sized to receive the head portion of the structural member and having an aperture therein; and a second member having a central body with first and second ends with a locating hook at each end sized and shaped to mate with either of the apertures on the first and third legs of the first member, and a pair of resilient locking tabs adjacent each locating hook, the locking tabs positioned to engage the lateral edges of the third leg of the first member when the adjacent locating hook is received in the apertures in the third leg.

9. The system according to claim 8 further comprising a bolt supported by the first leg of the first member, the bolt having a length of cable secured thereto for supporting a fixture.

10. The system according to claim 9 wherein the bolt includes external threads and the cable is secured to the bolt by an internally-threaded first coupler.

11. The system according to claim 10 further comprising a canopy having an aperture sized to fit over the first coupler, the first coupler also having external threads, and a second coupler having internal threads that mate with the external threads on the first coupler to secure the canopy against the first horizontal leg of the first member of the mounting clip.

12. The system according to claim 11 further comprising a slidable assembly received on the cable, the slidable assembly being selectively secured along the length of the cable and being adapted to secure a fixture thereto.

13. The system according to claim 8 wherein the central body of the second member of the mounting clip is relieved adjacent each pair of locking tabs in a first area corresponding to the horizontal and vertical dimensions of the cross flange of the structural member and in a second area corresponding to the head portion of the structural member.

14. The mounting clip of claim 13 wherein the first relieved areas are of different shape from each other and the second relieved areas are of different shape from each other so that the mounting clip can accommodate structural members of different sizes depending on the orientation of the second member of the mounting clip with respect to the first member.

15. The mounting clip of claim 8 wherein the clip is adapted to support a separate bolt having a head and shank, the first member further comprising a countersunk portion on the first leg, with a central aperture therein, the countersunk portion sized to receive the head of the bolt and the central aperture sized to receive the shank of the bolt.

16. A mounting clip for attachment to a T-shaped structural member having a cross flange with a horizontal and vertical dimension, a head portion, and a central web connecting the cross flange to the head portion, the mounting clip comprising:

a first member having a first horizontal leg sized so as to underlie the horizontal portion of the cross flange of the structural member, a second leg depending from the first leg sized and shaped to accommodate the vertical portion of the cross flange and the central web, and a third leg depending from the second leg sized to receive the head portion of the structural member; and a second member having a central body with first and second ends, the first and second ends of the second member having one of either a locating hook or an aperture and the first and third legs of the first member having the other of a locating hook or aperture, the locating hooks sized to mate with the apertures, and a pair of resilient locking tabs adjacent each end of the central body, the locking tabs positioned to engage the lateral edges of the third leg of the first member when the locating hooks are received in the aperture in the third leg.

17. The mounting clip of claim 16 wherein the central body of the second member is relieved adjacent each pair of locking tabs in a first area corresponding to the horizontal and vertical dimensions of the cross flange of the structural member and in a second area corresponding to the head portion of the structural member.

18. The mounting clip of claim 16 wherein the first relieved areas are of different shape from each other and the second relieved areas are of different shape from each other so that the mounting clip can accommodate structural members of different sizes depending on the orientation of the second member of the mounting clip with respect to the first member.

19. The mounting clip of claim 16 wherein the clip is adapted to support a separate bolt having a head and shank, the first member further comprising a countersunk portion on the first leg, with a central aperture therein, the countersunk portion sized to receive the head of the bolt and the central aperture sized to receive the shank of the bolt.

* * * * *